US009669507B2

(12) United States Patent
Hollo et al.

(10) Patent No.: US 9,669,507 B2
(45) Date of Patent: Jun. 6, 2017

(54) METHOD OF SHARPENING A BLADE AND METHOD OF USING A CUTTING DEVICE

(75) Inventors: John Hollo, Williamstown (AU); Ross Kaigg, Croydon Hills (AU)

(73) Assignee: Rosjoh Pty Ltd, Tullamarine (AU)

( * ) Notice: Subject to any disclaimer, the term of this patent is extended or adjusted under 35 U.S.C. 154(b) by 446 days.

(21) Appl. No.: 14/119,852

(22) PCT Filed: May 18, 2012

(86) PCT No.: PCT/AU2012/000551

§ 371 (c)(1),
(2), (4) Date: Feb. 12, 2014

(87) PCT Pub. No.: WO2012/159149

PCT Pub. Date: Nov. 29, 2012

(65) Prior Publication Data

US 2015/0053054 A1 Feb. 26, 2015

(30) Foreign Application Priority Data

May 23, 2011 (AU) ..... 2011901973

(51) Int. Cl.

| | |
|---|---|
| ***B24B 3/36*** | (2006.01) |
| ***B26D 5/00*** | (2006.01) |
| ***B26F 1/38*** | (2006.01) |
| ***B26D 7/12*** | (2006.01) |

(52) U.S. Cl.

CPC ..... *B24B 3/36* (2013.01); *B26D 5/005* (2013.01); *B26D 5/007* (2013.01); *B26D 7/12* (2013.01); *B26F 1/3813* (2013.01); *Y10T 83/04* (2015.04)

(58) Field of Classification Search

CPC .. B24B 3/00; B24B 3/36; B24B 3/361; B26B 1/00; B26B 3/00; B26B 5/00; B26B 7/00

See application file for complete search history.

(56) References Cited

U.S. PATENT DOCUMENTS

| | | | | |
|---|---|---|---|---|
| 3,894,362 A * | 7/1975 | Graves | B24D 15/08 | 451/552 |
| 4,197,677 A * | 4/1980 | Graves | B24D 15/06 | 451/555 |
| 4,272,925 A * | 6/1981 | Graves | B24D 15/06 | 451/552 |
| 4,450,653 A * | 5/1984 | Fletcher | B24D 15/08 | 248/171 |

(Continued)

FOREIGN PATENT DOCUMENTS

WO 2011112924 A1 9/2011

OTHER PUBLICATIONS

Australian Patent Office, International Search Report of PCT/AU2012/000551, Aug. 6, 2012, WIPO, 8 pages.

*Primary Examiner* — Jason Daniel Prone
*Assistant Examiner* — Richard Crosby, Jr.
(74) *Attorney, Agent, or Firm* — McCoy Russell LLP

(57) ABSTRACT

The present invention relates to the field of image processing. In one form, the invention relates to image processing as applied to digital processing and/or digitization of an image and/or photo. In one particular aspect the present invention is suitable for use in computer controlled knife cutting systems. The present invention uses an 'auto center' feature in association with the tracing of an image to provide a number of advantage.

12 Claims, 9 Drawing Sheets

(56) References Cited

U.S. PATENT DOCUMENTS 4,530,188 A * 7/1985 Graves ..... B24D 15/081 451/461
4,602,531 A * 7/1986 Korhonen ..... B24B 3/546 451/164
4,627,194 A * 12/1986 Friel ..... B24B 3/546 451/163
4,640,058 A * 2/1987 Glesser ..... B24D 15/06 451/540
4,646,477 A * 3/1987 Robertson ..... B24D 15/081 451/540
4,719,722 A * 1/1988 Washburn ..... B24D 15/08 451/557
4,751,795 A * 6/1988 Jenne ..... B24D 15/081 451/461
4,799,335 A * 1/1989 Battocchi ..... B24D 15/08 451/241
4,864,897 A * 9/1989 Newman ..... B23D 63/162 76/31
5,245,789 A * 9/1993 Rees ..... B24B 3/54 451/198
5,390,431 A * 2/1995 Friel ..... B24B 3/54 451/45
D365,740 S * 1/1996 Smith ..... D8/93
5,582,535 A * 12/1996 Friel ..... B24D 15/068 451/321
5,626,065 A 5/1997 Cattini
5,678,500 A * 10/1997 Schmidt ..... A01C 7/20 111/164
6,168,509 B1 * 1/2001 Presgrove ..... B24D 15/08 451/371
6,251,003 B1 * 6/2001 LeVine ..... B24D 15/06 451/423
6,330,750 B1 * 12/2001 Meckel ..... A61B 17/3213 30/346.54
6,453,559 B1 * 9/2002 Marshall ..... B26B 27/005 30/152
6,748,836 B2 * 6/2004 Vivirito ..... B24B 3/36 451/423
6,846,231 B2 * 1/2005 Oles ..... B24B 3/36 451/415
6,875,093 B2 * 4/2005 Friel, Sr. ..... B24B 3/546 451/260
7,037,175 B1 * 5/2006 Spiro ..... A61B 17/3211 451/45
7,144,310 B2 * 12/2006 Longbrake ..... B24D 15/08 451/349
7,722,443 B2 * 5/2010 Levsen ..... B24B 3/54 451/261
D640,523 S * 6/2011 Stutz ..... D8/93
7,993,183 B2 * 8/2011 Zinniger ..... B27G 13/04 451/293
8,267,750 B2 * 9/2012 Friel, Sr. ..... B24D 15/08 451/349
8,316,550 B2 * 11/2012 Howells ..... B26B 9/00 30/346.53
8,926,408 B2 * 1/2015 Hasegawa ..... B24D 15/082 451/192
D760,573 S * 7/2016 Wang ..... D8/91
2002/0142182 A1 * 10/2002 Peker ..... B26B 9/00 428/544
2011/0034111 A1 2/2011 Elek et al.

* cited by examiner 32
34
30
36
32
30
36
z
y
x

Fig. 12a
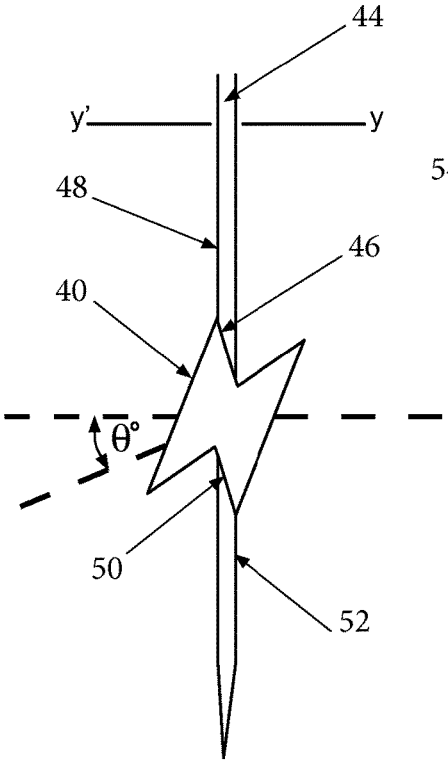
Fig. 12b
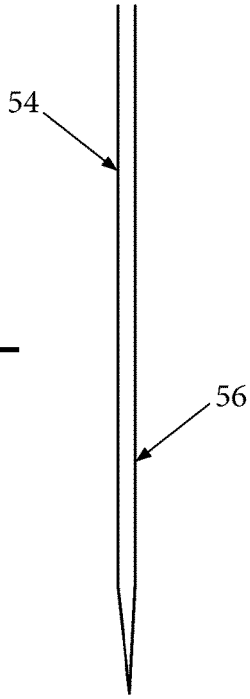
Fig. 12c
Fig. 12d
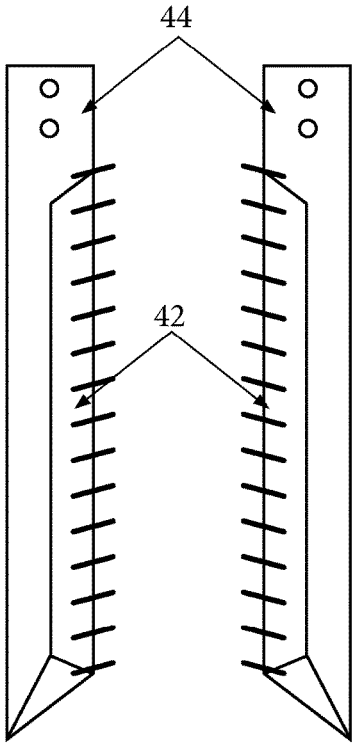

METHOD OF SHARPENING A BLADE AND METHOD OF USING A CUTTING DEVICE

CROSS-REFERENCE TO RELATED APPLICATIONS

This is the U.S. National Phase of International PCT Application Serial No. PCT/AU2012/000551 filed on May 18, 2012, entitled "Improvements in Knife Sharpening Tools," which claims priority to Australian Provisional Patent Application No. 2011901973 filed 23 May 2011, each of which are hereby incorporated by reference in their entirety for all purposes.

FIELD OF INVENTION

The present invention relates to improvements in industrial machines and method of using same.

In one form, the invention relates to image processing as applied to digital processing and/or digitisation of an image and/or photo, particularly in computer controlled knife cutting systems.

In another form, the invention relates to sharpening blades in industrial machines, particularly knife cutting machines.

It will be convenient to hereinafter describe the invention in relation to improvements in computer controlled knife cutting systems, however it should be appreciated that the present invention is not so limited and can be applied to a wide range of industrial machines and their methods of use.

In particular the improvement relating to digitised imaging can not only be used to improved an image in a computer controlled knife cutting system, but could also be used for any application which requires representation of a true shape in digital format.

BACKGROUND ART

In presently available computer controlled knife cutting systems various materials are cut into desired shapes. In the normal process of automatic knife cutting, the knife is plunged down into the material to be cut. During this plunging motion, the knife may be reciprocating or non-reciprocating. The knife will then be moved in directions corresponding to the two dimensional shapes required. During the cutting motion the knife is reciprocating to provide the slicing action required to cut the material. In order to maintain smooth, efficient and accurate cutting the knives must be kept sharp. This is usually achieved by periodically applying a sharpening tool (such as a sharpening band or stone) to the knife blade.

The movement of the knives of the knife cutting system is computer controlled with the desired shapes being programmed into the cutting system. It is thus necessary for the shapes to be represented in a form that can be recognised by the system that controls the cutting knives.

Typically shapes can be represented (created) digitally in the following ways:

1. Created by computer software (Computer Aided Design CAD). This software is used in many industries and software is varied from general engineering purposes to specialised software designed for niche manufacturing applications such as furniture, apparel, footwear, gaskets, automotive seating, etc.

2. Digitising—there are many devices that are available for digitising pattern pieces. To digitise a pattern piece you need to have a pattern (original or representative to scale or not to scale). Some of the digitising devices include:

- Digitising Table—this is a table that you would place a pattern onto. The operator would then trace (or click points) manually around the pattern piece whilst the pattern is resting on the table.
- Digitising flatbed scanner—this can be a scanner similar to a typical office desktop scanner (often on a larger scale). The digital image is processed by computer software and the computer software will automatically determine the perimeter shape of the scanned pattern including internal markings that may represent drill holes and cut outs.
- Feeding scanner—this is typically a scanner that receives a pattern piece and feeds in through a scanning device. The result is a captured image same as 'b)' above and the pattern image is processed by computer software and the computer software will automatically determine the perimeter shape of the scanned pattern including internal markings that may represent drill holes and cut outs.
- Camera (or other image capturing device)—camera (or other image capturing device) captures the image and image same as 'b)' above and the pattern image is processed by computer software and the computer software will automatically determine the perimeter shape of the scanned pattern including internal markings that may represent drill holes and cut outs.

3. In some cases, it is possible to input the shape as a digital image into programs like illustrator and Corel Draw and trace the image to generate a representation of the pattern (digitise) usable by existing cutting machines. However, because the image is presented on a computer screen which has a limited size, and given that the shapes to be digitised are often much larger than can be displayed wholly on the screen, the operator must resize and/or reposition the image several times as the digitising process takes place. This slows the process down considerably and may also introduce operator errors due to the need to manually move the image on the screen whilst undertaking the digitising process so that new area of the image can be viewed for digitising.

There are many problems with existing knife cutting systems, including, but not limited to:

- Handling very small shapes—it is difficult to accurately capture the true shape;
- Manual operator—errors can be introduced by the use of manual inputs to the digital capture system;
- Very large shapes are difficult to fit into the size available within existing digitizing systems;
- There is a lack of flexibility in the shapes able to be accommodated by existing digitizing systems.

Further problems are associated with sharpening the knives of existing knife cutting systems. Most automatic knife sharpening systems of the prior art drive a spinning or rotating sharpening tool (such as a sharpening band or stone) which makes contact with the knife at an angle appropriate to sharpen the knife. The knife can be reciprocating or static. To sharpen the full length of the knife various methods can be used. For example, the sharpening tool may be moved along the length of the stationary blade, or alternatively the length of the blade may be moved along the stationary sharpening tool.

The abovementioned sharpening systems of the prior art include disadvantages such as:

- the need to slow, delay or halt the cutting process to sharpen the knife blades, thus reducing productivity,
- the sharpening is not necessarily even on each side of the knife blade, the design complexity associated with spinning a sharpening tool, leading to a need for regular maintenance and replacement of parts due to excessive wear, some systems fail to sharpen the knife blade along its entire cutting edge.

Accordingly there is a need for improving the operation of knife cutting systems of the prior art.

Throughout this specification the use of the word "inventor" in singular form may be taken as reference to one (singular) inventor or more than one (plural) inventor of the present invention.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

SUMMARY OF INVENTION

An object of the present invention is to provide improved digitisation of an image.

Another object of the present invention is to provide improved representation of a true shape in digital format.

Another object of the present invention is to provide improved representation of a true shape in digital format in a computer controlled knife cutting system.

Another object of the present invention is to provide improved knife sharpening in a knife cutting system.

It is an object of the embodiments described herein to overcome or alleviate at least one of the above noted drawbacks of related art systems or to at least provide a useful alternative to related art systems.

In a first aspect of embodiments described herein there is provided a method of tracing an image in order to provide an improved digitised image, (optionally for use by a computer controlled knife cutting device and/or system), the method comprising displaying at least a portion of an image, enabling a user to trace at least a portion of the displayed image by selecting at least one point on the displayed image, and centering the displayed image substantially on a point selected by the user.

While the method is preferably used to improve an image in a computer controlled knife cutting system it will also be suitable for many applications which require a true shape in digital format. For example, a wide range of shapes or patterns may be digitised and then recorded by an inkjet printer or any other type of plotter or printer.

In another aspect of embodiments described herein there is provided in a computer controlled knife cutting system, an improved image tracing device, comprising display means adapted to display at least a portion of the image, tracing means adapted to enable a user to trace at least a portion of the displayed image by selecting at least one point on the displayed image, and image centring means adapted to centre the displayed image substantially on a point selected by the user.

Other aspects and preferred forms are disclosed in the specification and/or defined in the appended claims, forming a part of the description of the invention.

In essence, embodiments of the present invention stem from the realization that the use of an 'auto centre' feature in association with the tracing of an image being used by a computer controlled knife cutting device and/or system provides improved image digitisation, useful in the cutting, storing and/or plotting of patterns. In particular, the present invention enables the 'auto centre' of at least a portion of an image with reference to the last point that was entered.

Furthermore, the present invention may be used for digitising patterns applicable for cutting manually or automatically on a CNC cutter OR for the plotting of patterns for hand cutting.

Advantages provided by the present invention comprise the following:

in the process of digitising some images or shapes, the display of the image or shape needs to be zoomed 'in' or 'out' so that a more accurate digitising process can be achieved. Because the present invention causes the display of at least a portion of the image to be substantially 'centred' based on the last point entered, the relatively immediate portion of the image being digitised by the operator will be substantially displayed on the screen.

the original image is referenced to ensure correct digitising.

relatively less restriction in the size of pattern to the size of the physical digitising table.

do not need the physical floor space required by the digitising table.

do not need to be in the physical location of the digitising table to perform the digitising task. For example: you can email the photo image with size reference across the world for digitising.

the cost of a camera is far less than a digitising table.

photo digitising allows the capturing of the digital image and the actual digitising to happen in different locations. The physical pattern does not need to be transported. For example: a customer in New York may take a digital image of a pattern required for production and email this image to a production facility in Los Angeles. The Los Angeles facility may digitise and/or trace the pattern so that it can be cut by a machine, also at any location.

having the operator follow the contour of the digital scan by tracing or adding points around the pattern enables a human to determine what is the correct shape and ignore markings that may otherwise confuse a software package operating alone automatic digital scanning requires contrast between the pattern digitised and the background to determine the shape—this is not necessary with the present invention automatic digital scanning often requires a manual clean up of points that are generated because the scanning process has picked up markings on the pattern that are not part of the pattern information that needs to be collected—this is not necessary with the present invention avoids damaged to pattern pieces through repeated use in prior art systems over years of use or perhaps not created correctly.

enables storage or creation of a 'library' of images for future reference, and the operator can make critical decisions during the digitising process.

Throughout the specification, the words 'shape' and 'image' are used interchangeably—but do refer to an overall outline of an article. The edge(s) of the article are where a cut or hole is to be made with the system of the present invention in order to define the article.

Also throughout the specification, 'centring' or 'centre' of the display or image is not to be taken with mathematical precision. Substantially near or in proximity of the centre is considered within the scope of the present invention.

In another aspect of embodiments described herein there is provided a sharpening tool for sharpening a knife in a knife cutting device, the tool comprising a first sharpening surface and a second sharpening surface, wherein during a sharpening process the first sharpening surface and second sharpening surface are alternately applied to opposite sides of the knife.

The first sharpening surface and second sharpening surface may be applied simultaneously to opposite sides of the knife, or applied one after the other.

The sharpening surfaces are applied to the sides of the knife adjacent where they meet to form the knife blade. Each sharpening surface is specific to one side of the blade. Typically, during the sharpening process the sharpening surface is passed along the entire length of the blade, all the way to the tip of the knife.

In another aspect of embodiments described herein there is provided a method of sharpening the blade of a knife in a knife cutting device using the sharpening tool of the present invention, the method comprising the steps of:

(i) applying the first sharpening surface to a first side of the blade while the second sharpening surface is applied to a second surface of the blade, and subsequently, (ii) applying the first sharpening surface to the second side of the blade while the second sharpening surface is applied to the first surface of the blade.

Carrying out steps (i) and (ii) provide a 'flip-flop' action of the sharpening tool. Steps (i) and (ii) may be repeated as many times as required to obtain the desired knife sharpness.

In a preferred embodiment the two sharpening surfaces form a generally V-shaped conformation. Typically the first sharpening surface and the second sharpening surface are diagonally opposed and may be parallel. In a particularly preferred embodiment, the sharpening tool is disk shaped, the two cutting surfaces forming a generally V-shaped recess in the periphery of the disk. The disk may for example, be rotating so that fresh parts of the sharpening surfaces are continually exposed during the sharpening process.

The sharpening surface may comprise any convenient natural or synthetic material and includes combinations of materials. For example the sharpening surface may comprise a bonded abrasive composed of fine particles of a hard material such as silicon carbide (carborundum), aluminium oxide (corundum) or diamond grit. Alternatively the sharpening surface may comprise natural stone.

Typically the angle of application of the sharpening tool sharpening surface to the knife blade is optimised to obtain maximum blade sharpness. The smaller the angle between the blade and sharpening surface, the sharper the blade but the less side force is needed to bend or chip the edge. The angle between the blade and the sharpening surface is the edge angle. Typical edge angles are about 20°, however the edge angle for very sharp knives can be as little as 10 degrees. Knives that require a tough edge may be sharpened using an edge angle of 25° or more.

Preferably, in the sharpening method of the present invention the edge angle is varied between steps (i) and (ii) or during subsequent repetitions of these steps. More specifically, a first edge angle may be used in step (i) and a second edge angle may be used in step (ii), the first and second edge angles being different. Alternatively, a first edge angle may be used for both steps (i) and (ii) and a second edge angle may be used for a subsequent repetition of step (i) or step (ii). The ability to change the edge angle has the advantage of changing the dynamics of the grinding and can be used to optimise blade sharpness. The edge angle may be automatically changed randomly, or alternatively in a desired specified sequence.

The sharpening tool can be brought into and out of contact with the knife by any convenient method including, but not limited to, inertia, mechanical, electrical or pneumatic methods. Typically the sharpening tool is applied to the knife during operation of the automatic knife cutting process without interrupting the sequence of automatic knife cutting steps.

In another aspect of embodiments described herein there is provided a method of cutting material using a knife cutting device, the method comprising the steps of:

(i) plunging a knife of the knife cutting device into material to be cut, (ii) moving the knife in the directions required to cut the material into a desired two dimensional shape, (iii) raising the knife out of the material, (iv) sharpening the knife using a sharpening tool having a first sharpening surface and a second sharpening surface, by (iv)(a) applying the first sharpening surface to a first side of the blade while the second sharpening surface is applied to a second side of the blade, and subsequently, (iv)(b) applying the first sharpening surface to the second side of the blade while the second sharpening surface is applied to the first side of the blade.

The cutting steps (i) to (iv) can be repeated as many times as required with the blade being sharpened while it is lifted in preparation for cutting the next shape or next piece of material. Step (iv) can occur during plunging step (i) but is more likely to occur during the lifting step (iii). Thus the material cutting process can operate without interruption.

In essence, embodiments of the sharpening improvement of the present invention stem from the realization of the beneficial sharpening effect of alternating the angle of application of the sharpening tool to the blade of the knife. This provides the 'flip-flop' effect by virtue of carrying out step (i) then step (ii).

Advantages provided by the knife sharpening improvement of the present invention comprise the following:

improved sharpness of the knife blade;

even sharpening of each side of the knife blade;

no need to slow, interrupt or halt the cutting process to sharpen the knives.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which:

FIGS. 12*a-d* illustrate the sharpening routine from different perspectives.

DETAILED DESCRIPTION

Figure 1:
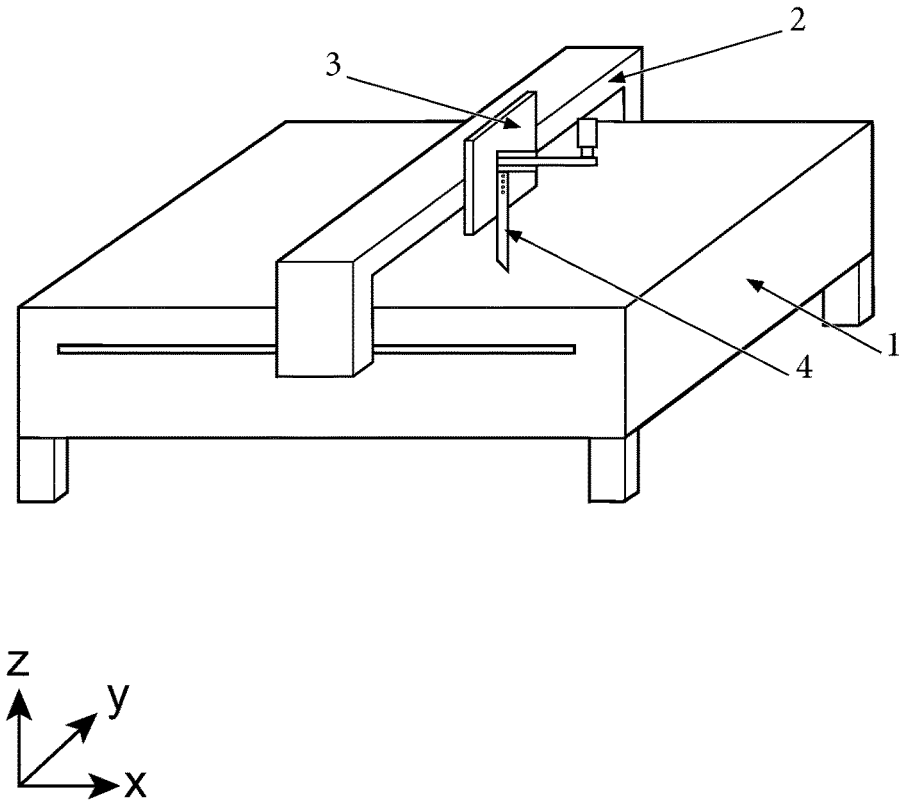
FIG. 1 illustrates an automatic knife cutting system of the type relevant to the present invention.

FIG. 1 illustrates an automatic knife cutting system of the type relevant to the present invention. In this illustration can be seen the cutting table 1 having a moveable arm 2 on which is mounted the cutting head 3 bearing the knife 4. The material to be cut is laid flat on the surface of the cutting table 1, underneath the cutting head 3. The normal sequence in the automatic knife cutting process consists of (1) plunging the knife into the material to be cut, (2) moving the knife in the directions required to cut the material into the desired two dimensional shape, and (3) raising the knife out of the material in preparation for the next cutting sequence. The knife is kept sharp by periodically applying a sharpening tool having a surface composed of material that is harder (measured on the Mohr scale) than the composition of the surface of the blade being sharpened.

The automatic knife cutting system moves in three dimension—the cutting arm 3 moving the knife in the direction of the X and Y axes to give the two dimensional path of the shape to be cut. The cutting head 3 is adapted to move the knife 4 in the direction of the Z axis and to rotate the knife so that the cutting edge of the knife blade is tangential, or approximately tangential to the path of the desired shape to be cut. When the knife is plunged down into the material to be cut, the material on the cutting surface of the table is made available to the knife 4 by virtue of movement of the cutting arm 3 in the directions of the X and Y axes. The knife will then move in a tangential or approximately tangential direction 'steered' so that it followed the two dimensional shapes required. During the cutting process the knife 4 is reciprocating, providing the slicing action required to cut the material.

With reference to FIGS. 2 to 9, reference is made to two dimensional shapes. The present invention, however, is not to be limited only to two dimensional shapes.

Figure 2:
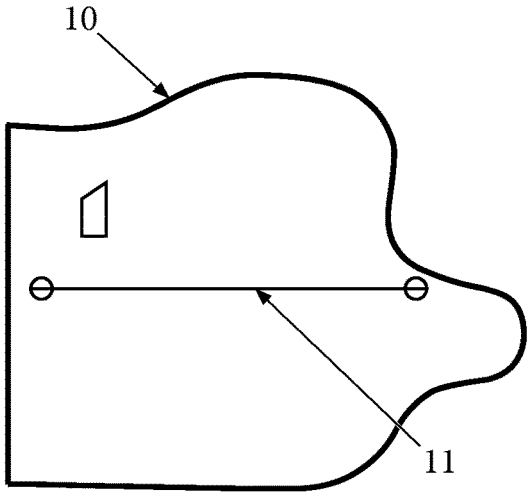
FIG. 2 illustrates a representation of a digital image captured by a camera.

Initially, a digital image is captured for example by a camera or other suitable image capturing means and is entered into the system of the present invention. FIG. 2 illustrates a representation 10 of a scanned digital image captured by a digital camera. Preferably, when the image is first scanned, an 'elastic' ruler 11 is displayed in a default location. The ruler can be located anywhere or perhaps there can be a button pressed to expose the ruler.

Figure 3:
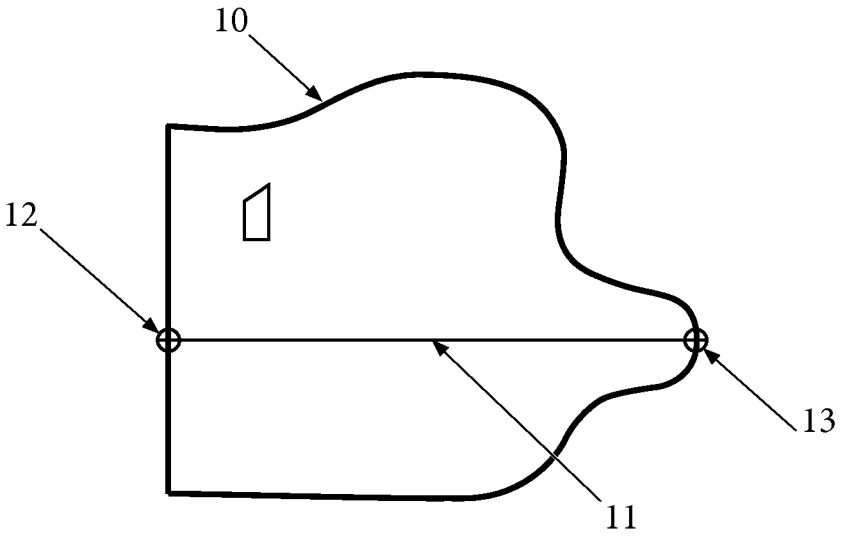
FIG. 3 illustrates scaling of an image.

A reference to scaling of the image 10 may be set as illustrated in FIG. 3. This can be accomplished by dragging the ends of a ruler line 11 on the screen, across the displayed digital image thereby creating two reference points (shown as points 12 & 13 in FIG. 3). The distance between the points 12, 13 may be a known distance, calculated by the system or input by the user. Thus the distance and scale may be set by fixed markings that may be referenced manually or automatically or by a scaling ruler. The scaling ruler may be moved to points that have a known length. The length may be entered (lower left) 14 and the scale is set. Scaling should not be limited to a manual operation as it is possible for the scale to be set automatically.

The scaled image is entered as a background into the present invention. It is possible that the image is be entered into the present invention and scaled at any later time. The required pattern image is now to be digitised manually by software tools as shown.

Figure 4:
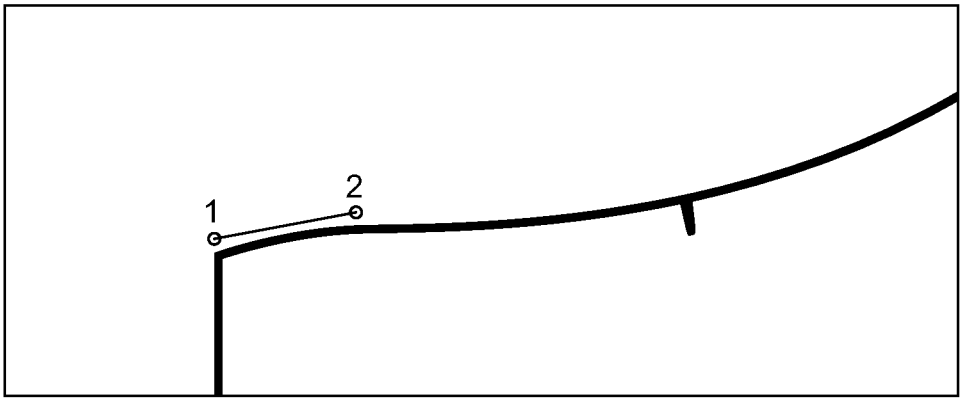
FIG. 4 illustrates initial tracing of an image.

With reference to FIG. 4, the process of tracing the input image may commence by a user 'clicking' at a first point 1, and then 'clicking' on a second point 2. This serves to trace the line between points 1 and 2 as an input to the present invention as a 'captured' representation of the digital image. Also, after point 2 is 'clicked', the present invention will then substantially 'centre' the displayed image relative to point 2.

Although the trace illustrated in the drawings is a series of straight lines, the present invention may trace any shaped line between points. The line may be straight, curved or otherwise, and/or may be set and/or adjusted by the user.

Figure 5:
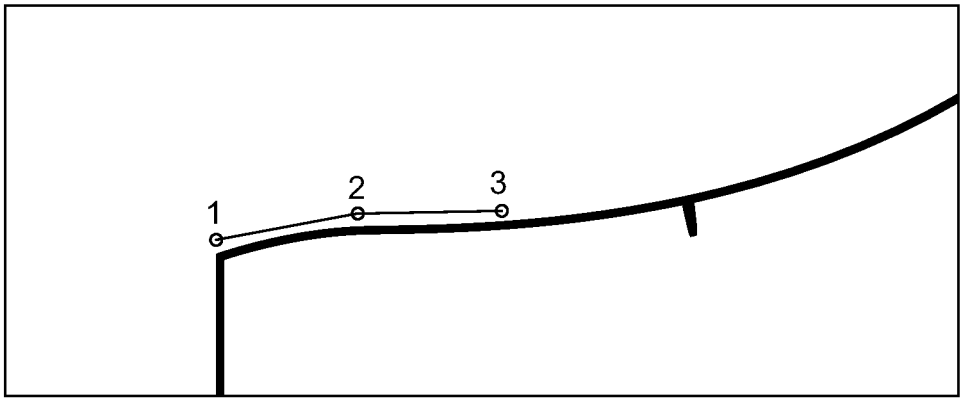
FIGS. 5 and 6 illustrate further tracing of the image.
Figure 6:
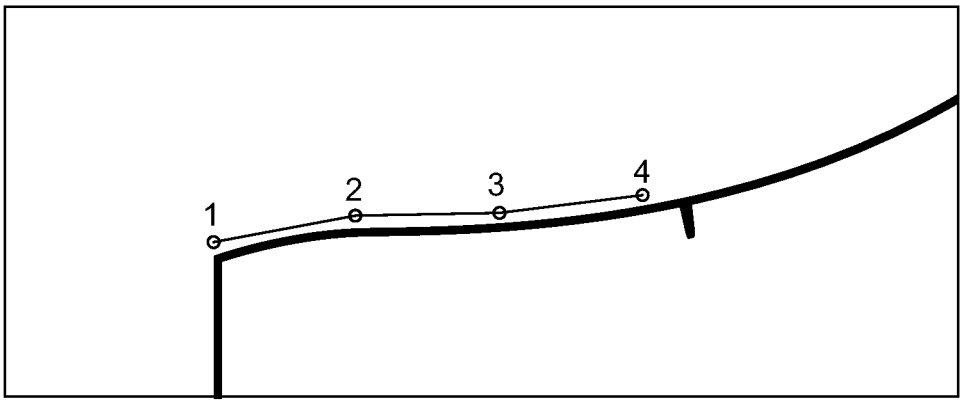

With reference to FIG. 5, the process of tracing can continue with the user next 'clicking' on point 3. This serves to trace the line between points 2 and 3 as an input to the present invention as a 'captured' representation of the digital image. Also, after point 3 is 'clicked', the present invention will then substantially 'centre' the displayed image relative to point 3.

Again, but referring to FIG. 6, the process of tracing can continue with the user next 'clicking' on point 4. This serves to trace the line between points 3 and 4 as an input to the present invention as a 'captured' representation of the digital image. Also, after point 4 is 'clicked', the present invention will then substantially 'centre' the displayed image relative to point 4.

Figure 7:
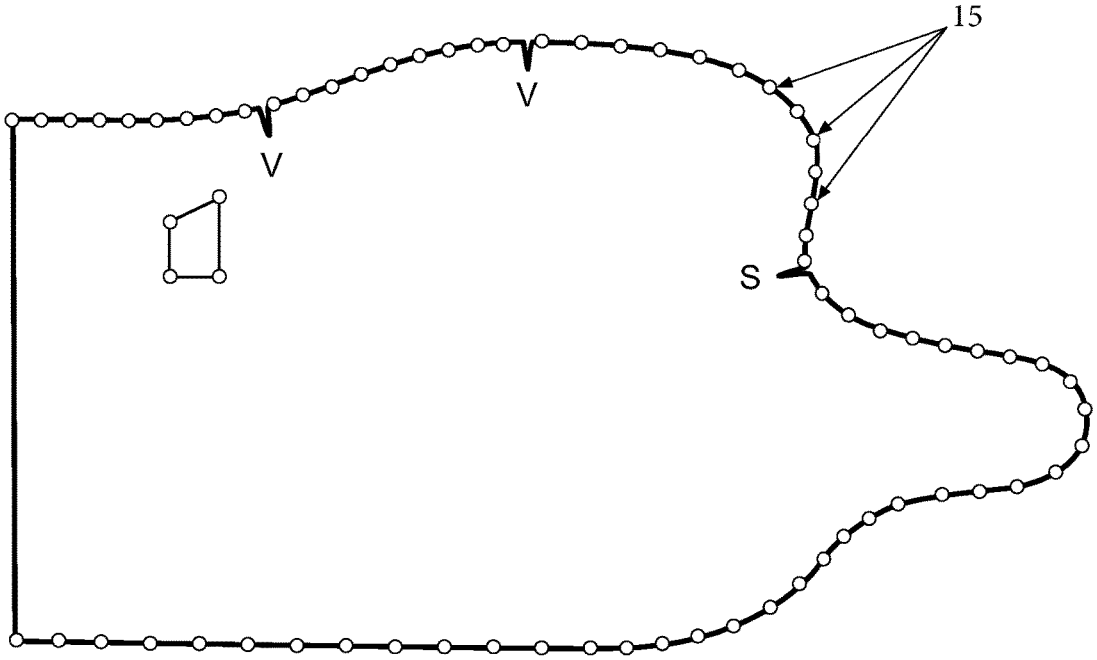
FIG. 7 illustrates a digitised shape.

This continues until the shape has been digitised, as is represented in FIG. 7. In accordance with the present invention, as image of FIG. 7 is traced, the points (dots) 15 representing 'clicks' will have been centred in the display, thus allowing the user to trace around the image without the necessity to move the image manually as is required with the prior art. This allows for the image to be moved automatically so that the next point can be digitised.

Figure 8:
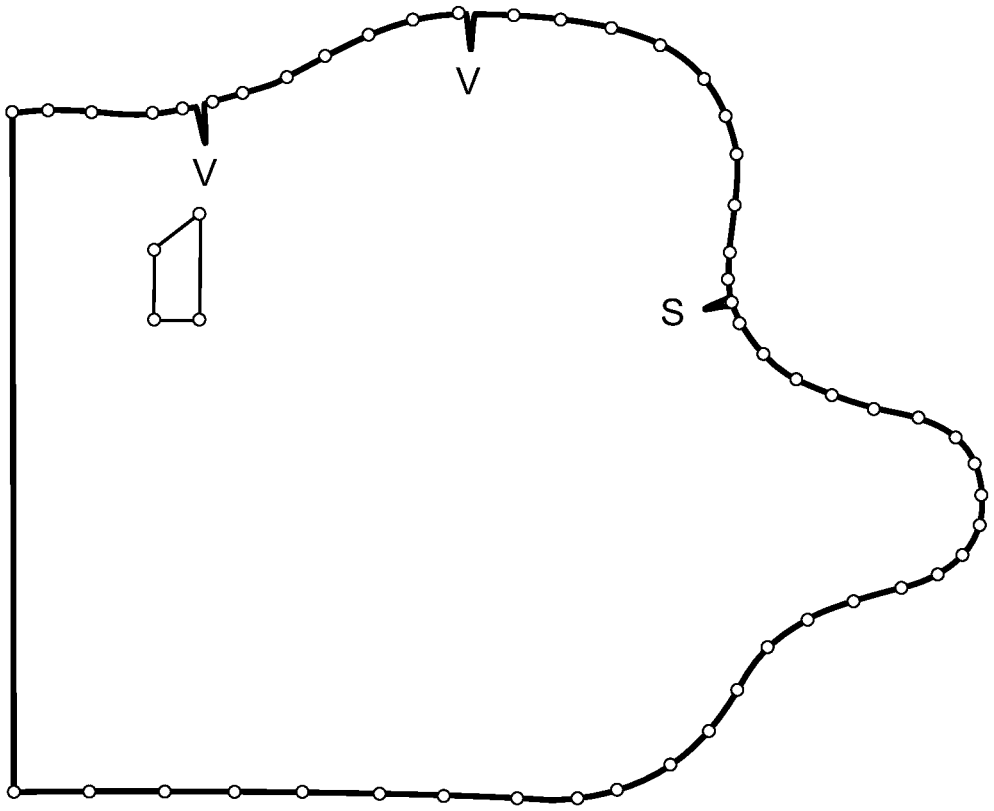
FIG. 8 illustrates the trace, with background image removed.

FIG. 8 illustrates the trace with numerous dots following the outline of the traced image, with background image removed.

Figure 9:
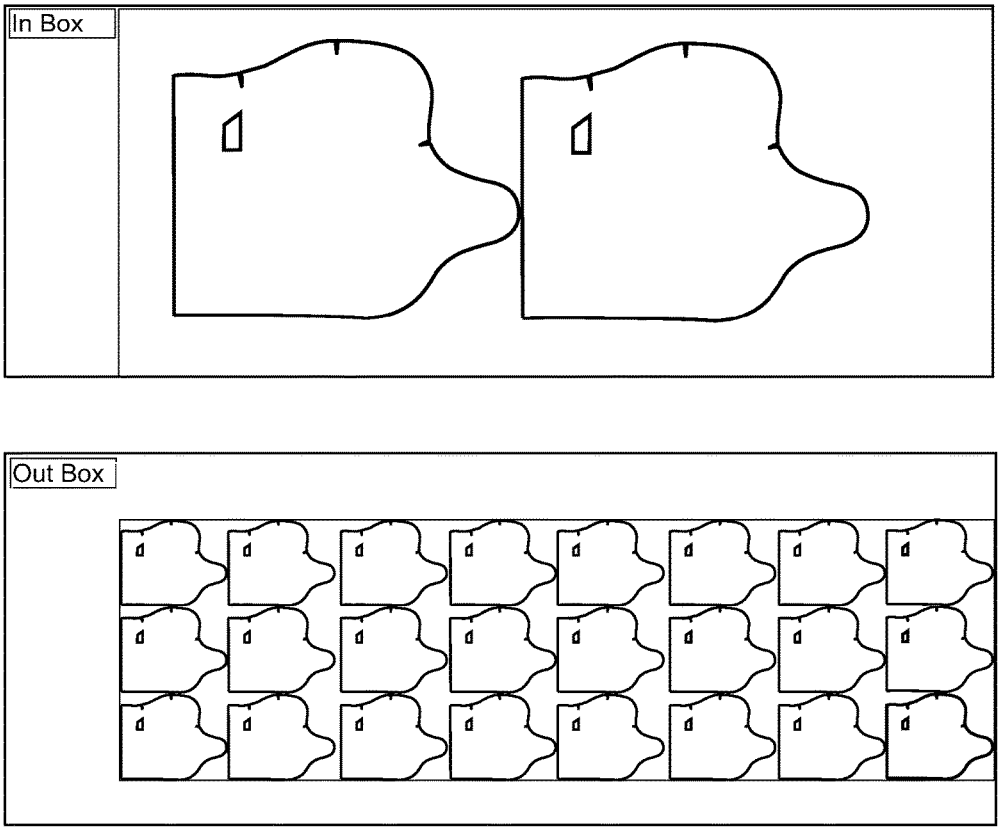
FIG. 9 illustrates the present invention as applied to digitising patterns for cutting manually on a CNC cutter OR plotting the patterns for hand cutting.

FIG. 9 illustrates the present invention as applied to digitising patterns for cutting manually on a CNC cutter OR plotting the patterns for hand cutting.

The auto-centering feature is now described. A 2D display area (for example a computer screen) with X coordinate ranging from 0 to W pixels and Y coordinate ranging from 0 to H pixels may be used to display a representation of an image. The centre of the display area is deemed to correspond to the coordinates (Cx, Cy) units. Distance in pixels is deemed to be related to distance in the real-world by a scale S pixels per unit. In one embodiment, Cx and Cy are in mm, and the scale is pixels per mm.

In determining the real-world position corresponding to a mouse click, represented by pixel (Mx,My), the following logic is applied. The corresponding real world (x,y) position is taken as a scaled offset from the centre of the display area. Considering the x axis first, the centre pixel is at 0.5W (half the width of the display area). The offset of the mouse click from the centre is Mx−0.5W pixels. The corresponding a real world distance is (Mx−0.5W)/S mm, and this is an offset from the known centre of the display. A similar line of reasoning applies to the Y axis. So the corresponding real-world position (X,Y) is where $$X=Cx+(Mx-0.5W)/S$$

$$Y=Cy+(My-0.5H)/S$$

In a common situation where My increases down the screen rather than upwards, the equation for Y changes to $$Y=Cy-(My-0.5H)/S$$

In adapting the above determination of the position of a mouse click to provide auto-centering, the clicked position (X,Y) is adopted as a 'centre' point by setting $$Cx=X$$

$$Cy=Y$$

and redrawing the display. The click position will now appear at the centre of the display area, ready for another mouse click.

The particular products shapes and materials produced by use of the present invention are many and varied, and the scope of the present invention should not be limited to only those illustrated in this specification.

Figure 10A:
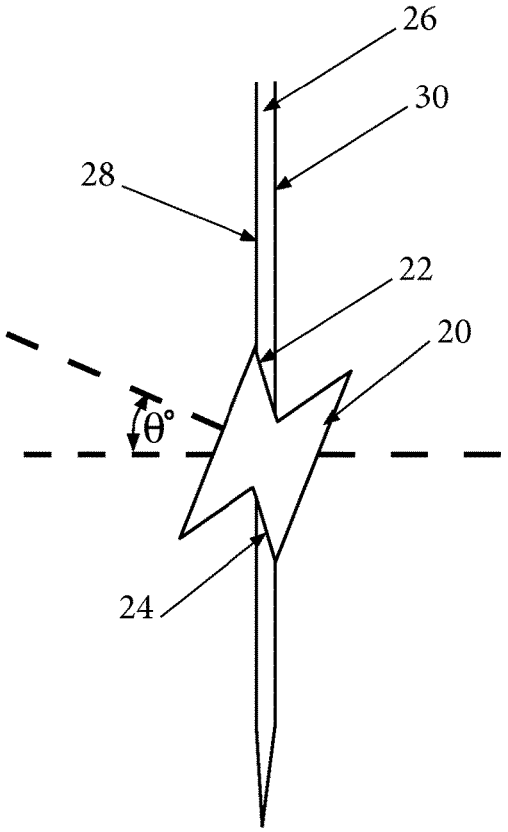
FIG. 10 illustrates the cutting tool of the present invention applied in one orientation to the blade of the knife (FIG. 10*a*) and the alternative orientation (FIG. 10*b*)
Figure 10B:
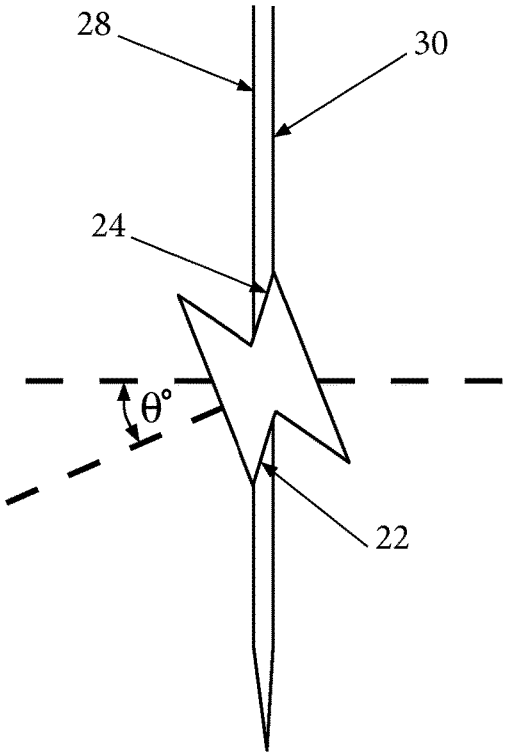

With reference to the knife sharpening improvement of the present invention, in one preferred embodiment the sharpening tool 20 is disk shaped includes a first sharpening surface 22 and a second sharpening surface 24 that form a V-shaped recess in the edge of the sharpening tool 20. The knife 26 has a first side 28 and a second side 30 which meet to form a blade to be sharpened. As shown in FIGS. 10*a* and 10*b*, the sharpening tool sharpens the knife by engaging the blade of the knife at an angle (Θ). The cutting tool of the present invention is shown applied in one orientation to the blade of the knife (FIG. 10*a*) and in an alternate orientation (FIG. 10*b*) and can alternate between these two orientations in a random manner, or according to a predetermined sequence.

Specifically, FIG. 10*a* shows the first sharpening surface 22 being applied to the first side 28 of the blade while the second sharpening surface 24 is applied to the second side 30 of the blade. FIG. 10*b* shows the first sharpening surface 22 being applied to the second side 30 of the blade while the second sharpening surface 24 is applied to the first side 28 of the blade. The improvement in the knife sharpening system according to the present invention is based on the realisation of the advantage in alternating the sharpening tool as shown from FIGS. 10*a* to 10*b*. The sharpening tool angle may be automatically changed randomly or alternatively in a specified sequence.

Figures 11A, 11B, 11C, 11D:
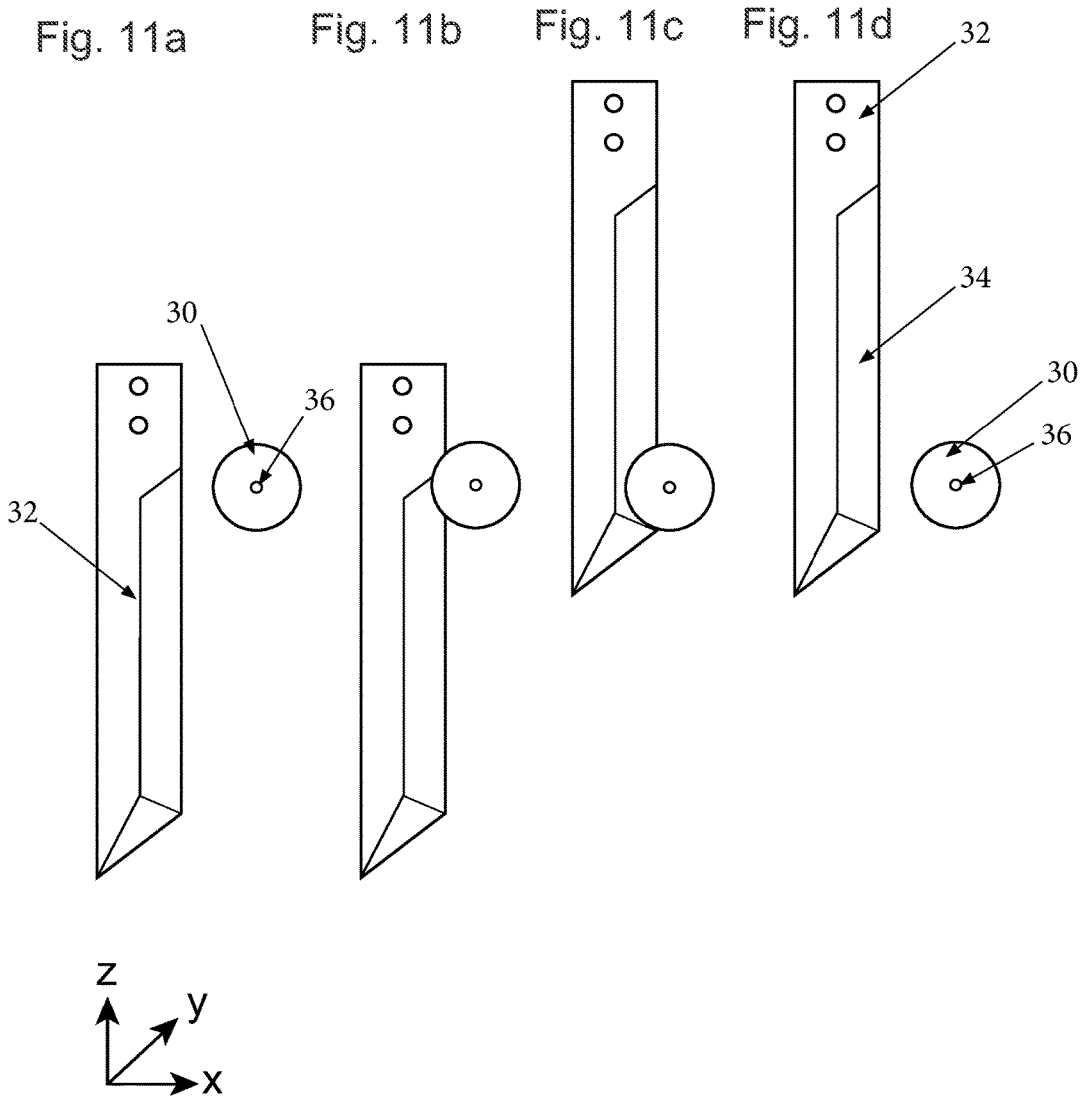
FIGS. 11*a-d* illustrate the motion of the sharpening tool of the present invention relative to a knife.

FIG. 11 illustrates the motion of a generally disk shaped sharpening tool 30 according to the present invention relative to a knife 32 having a blade 34. Specifically FIG. 11*a* illustrates the knife 32 of a cutting head (not shown) in the lowered, cutting position when into the material (not shown). FIG. 11*b* illustrates the sharpening tool 30 rotating about an axle 36 and moving in the direction of the X-axis to engage the upper part of the blade 34 at the desired angle (Θ) for sharpening. The knife 32 is then automatically lifted in the direction of the Z-axis. FIG. 11*c* illustrates the knife 32 in the fully lifted position, the sharpening tool 30 having run along the length of the blade 34. The sharpening tool 30 then moves in the direction of the X-axis to disengage from the blade 34. FIG. 11*d* illustrates the knife 32 disengaged from the sharpening tool 30.

FIG. 12 illustrates the position of a sharpening tool 40 at various times in the sharpening routine and from different perspectives. FIG. 12*a* shows the V-shaped recesses of the sharpening tool at angle (Θ) relative to the blade 42 of the knife 44. A first sharpening surface 46 is applied to a first side 48 of the blade 42 while the second sharpening surface 50 is applied to the second side 52 of the blade 42. FIG. 12*b* indicates the points 54,56 at which the first sharpening surface 46 and the second sharpening surface 50 contact respective sides of the blade 42.

FIGS. 12*c* and 12*d* illustrate the knife 44 of FIG. 12*a* viewed in the direction y-y' and y'-y respectively. These views illustrate the staggered sharpening pattern on the knife 44 (the sharpened areas being indicated by the diagonal lines along the edge of the blade 42 of the knife 44. When the sharpening tool is a disk it is preferably rotating as it contacts the blade so that fresh parts of the sharpening surfaces are continually exposed during the sharpening process.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

Various embodiments of the invention may be embodied in many different forms, including computer program logic for use with a processor (e.g., a microprocessor, microcontroller, digital signal processor, or general purpose computer and for that matter, any commercial processor may be used to implement the embodiments of the invention either as a single processor, serial or parallel set of processors in the system and, as such, examples of commercial processors include, but are not limited to Merced™, Pentium™, Pentium II™, Xeon™, Celeron™, Pentium Pro™, Efficeon™, Athlon™, AMD™ and the like), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an exemplary embodiment of the present invention, predominantly all of the communication between users and the server is implemented as a set of computer program instructions that is converted into a computer executable form, stored as such in a computer readable medium, and executed by a microprocessor under the control of an operating system.

Computer program logic implementing all or part of the functionality where described herein may be embodied in various forms, including a source code form, a computer executable form, and various intermediate forms (e.g., forms generated by an assembler, compiler, linker, or locator). Source code may include a series of computer program instructions implemented in any of various programming languages (e.g., an object code, an assembly language, or a high-level language such as Fortran, C, C++, JAVA, or HTML. Moreover, there are hundreds of available computer languages that may be used to implement embodiments of the invention, among the more common being Ada; Algol; APL; awk; Basic; C; C++; Conol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PL/I; Prolog; Python; Rexx; SAS; Scheme; sed; Simula; Smalltalk; Snobol; SQL; Visual Basic; Visual C++; Linux and XML.) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g, a RAM, ROM, PROM, EEPROM, or Flash-Programmable RAM), a magnetic memory device (e.g., a diskette or fixed disk), an optical memory device (e.g., a CD-ROM or DVD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies (e.g., Bluetooth), networking technologies, and inter-networking technologies. The computer program may be distributed in any form as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality where described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL). Hardware logic may also be incorporated into display screens for implementing embodiments of the invention and which may be segmented display screens, analogue display screens, digital display screens, CRTs, LED screens, Plasma screens, liquid crystal diode screen, and the like.

Programmable logic may be fixed either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM or DVD-ROM), or other memory device. The programmable logic may be fixed in a signal that is transmittable to a computer using any of various communication technologies, including, but in no way limited to, analog technologies, digital technologies, optical technologies, wireless technologies (e.g., Bluetooth), networking technologies, and internetworking technologies. The programmable logic may be distributed as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A method of sharpening a blade of a knife in a knife cutting device having a planar cutting surface and using a disc shaped sharpening tool comprising a first sharpening surface and a second sharpening surface that form a generally V-shaped recess in a periphery of the disc shaped sharpening tool, the method comprising steps of:

(i) in a first orientation of the disc shaped sharpening tool, applying the first sharpening surface to a first side of the blade at a first edge angle of $+\theta$ relative to a plane of the cutting surface while the second sharpening surface is applied to a second side of the blade, and subsequently, (ii) in a second orientation of the disc shaped sharpening tool, applying the first sharpening surface to the first side of the blade at a second edge angle of $-\theta$ relative to the plane of the cutting surface while the second sharpening surface is applied to the second side of the blade, the first edge angle different than the second edge angle; and (iii) moving the disc shaped sharpening tool to alternate between the first and second orientations.

2. The method according to claim 1 wherein the steps (i) and (ii) are repeated one or more times.

3. The method according to claim 1 wherein the first edge angle is used in the step (i) and the second edge angle is used in the step (ii), wherein the first and second edge angles are different.

4. The method according to claim 1 wherein the first edge angle is used for both the steps (i) and (ii) and the second edge angle is used for a subsequent repetition of the step (i) or the step (ii).

5. The method according to claim 1 wherein the first sharpening surface and/or the second sharpening surface is applied to a length of the blade of the knife.

6. The method according to claim 1 wherein the first sharpening surface and second sharpening surface are diagonally opposed.

7. The method according to claim 1 wherein application of the first sharpening surface and the second sharpening surface to the knife results in a staggered pattern on at least part of the blade due to the alternating between the first and second orientations.

8. A method of using a cutting device, the method comprising steps of:

(i) plunging a knife of the cutting device into a material, (ii) moving the knife in directions required to cut the material into a desired two dimensional shape, (iii) raising the knife out of the material, (iv) sharpening the knife using a disc shaped sharpening tool having a first sharpening surface and a second sharpening surface that form a generally V-shaped recess in a periphery of the disc shaped sharpening tool, by (iv)(a) in a first orientation of the disc shaped sharpening tool, applying the first sharpening surface to a first side of a blade of the knife at a first edge angle of $+\theta$ relative to a plane of the cutting surface while the second sharpening surface is applied to a second side of the blade, and subsequently, (iv)(b) in a second orientation of the disc shaped sharpening tool, applying the first sharpening surface to the first side of the blade at a second edge angle of $-\theta$ relative to the plane of the cutting surface while the second sharpening surface is applied to the second side of the blade, the first edge angle different than the second edge angle; and (iv)(c) moving the disc shaped sharpening tool to alternate between the first and second orientations;

wherein the sharpening tool is applied to the knife during operation of the knife cutting device.

9. The method according to claim 8 wherein the steps (i) to (iv) are repeated at least once.

10. The method according to claim 8 wherein the first sharpening surface and/or the second sharpening surface is applied to a length of the blade of the knife.

11. The method according to claim 8 wherein the first sharpening surface and second sharpening surface are diagonally opposed.

12. The method according to claim 8 wherein application of the first sharpening surface and the second sharpening surface to the knife results in a staggered pattern on at least part of the blade due to the alternating between the first and second orientations.

* * * * *